US012685385B2

(12) United States Patent
Ribbe

(10) Patent No.: US 12,685,385 B2
(45) Date of Patent: Jul. 21, 2026

(54) BIODEGRADABLE DISPOSABLE TOILET BRUSH

(71) Applicant: Geerpres, Inc., Norton Shores, MI (US)

(72) Inventor: Scott E. Ribbe, Grand Rapids, MI (US)

(73) Assignee: Geerpres, Inc., Norton Shores, MI (US)

( * ) Notice: Subject to any disclaimer, the term of this patent is extended or adjusted under 35 U.S.C. 154(b) by 517 days.

(21) Appl. No.: 18/216,326

(22) Filed: Jun. 29, 2023

(65) Prior Publication Data

US 2024/0000220 A1 Jan. 4, 2024

Related U.S. Application Data

(60) Provisional application No. 63/357,867, filed on Jul. 1, 2022.

(51) Int. Cl.

| | |
|---|---|
| ***A46B 5/00*** | (2006.01) |
| ***A46B 9/00*** | (2006.01) |
| ***A47K 17/00*** | (2006.01) |
| ***D03D 1/00*** | (2006.01) |
| ***D03D 15/217*** | (2021.01) |
| ***D03D 15/225*** | (2021.01) |

(52) U.S. Cl.

CPC ..... *A46B 9/005* (2013.01); *A46B 5/00* (2013.01); *A47K 17/00* (2013.01); *D03D 1/00* (2013.01); *D03D 15/217* (2021.01); *D03D 15/225* (2021.01); *A46B 2200/304* (2013.01); *D10B 2401/12* (2013.01); *D10B 2503/00* (2013.01)

(58) Field of Classification Search

CPC .. A47K 17/00; A47K 11/10; A46B 2200/304; A46B 9/005; A46B 5/00

See application file for complete search history.

(56) References Cited

U.S. PATENT DOCUMENTS

| | | | | |
|---|---|---|---|---|
| 6,623,201 | B2 * | 9/2003 | Brumlik | A46B 11/0013 401/278 |
| 2002/0054784 | A1 | 5/2002 | Wolf | |
| 2004/0107526 | A1 * | 6/2004 | Enzfellner | A47K 11/10 15/210.1 |
| 2005/0125922 | A1 * | 6/2005 | Szarawarski | E03D 9/00 15/104.16 |
| 2011/0010880 | A1 * | 1/2011 | Smith, Jr. | A46B 5/00 15/160 |

(Continued)

FOREIGN PATENT DOCUMENTS

| | | | | |
|---|---|---|---|---|
| CA | 2881574 | A1 * | 1/2014 | C11D 3/48 |
| CN | 103767327 | A * | 5/2014 | |

(Continued)

*Primary Examiner* — Michael D Jennings

(74) *Attorney, Agent, or Firm* — Miller Johnson

(57) ABSTRACT

A biodegradable toilet brush includes a biodegradable handle. The biodegradable toilet brush includes a brush head made of multiple layers of biodegradable fabric disks attached to and radiating outwardly from their attachment to the handle. Each of the fabric disks has a central slot dimensioned to receive the handle therethrough. The biodegradable toilet brush includes brush head retention pins that extend through spaced holes in the handle near a top of the handle and hold the fabric disks in place on the handle.

19 Claims, 6 Drawing Sheets

(56) References Cited

U.S. PATENT DOCUMENTS

| | | | | |
|---|---|---|---|---|
| 2011/0225751 | A1* | 9/2011 | Chapman | A46B 15/0081 15/114 |
| 2017/0298607 | A1* | 10/2017 | Cooper | E03C 1/302 |
| 2018/0042435 | A1* | 2/2018 | Mitchell | A47K 11/10 |
| 2019/0307235 | A1* | 10/2019 | Tomalesky | A46B 17/04 |
| 2021/0052117 | A1* | 2/2021 | O'Brien | A46B 5/0041 |
| 2021/0186183 | A1* | 6/2021 | Crapet | A46B 9/005 |
| 2022/0031055 | A1* | 2/2022 | Kirikian | A46B 9/005 |
| 2023/0286113 | A1* | 9/2023 | Schofield | B24D 13/10 |

FOREIGN PATENT DOCUMENTS

| | | | | | |
|---|---|---|---|---|---|
| DE | 10238131 | | | 2/2004 | |
| GB | 651454 | A | * | 4/1951 | A47K 11/10 |
| JP | 2006271644 | A | * | 10/2006 | |
| WO | WO 2013113044 | | | 8/2013 | |
| WO | WO-2021212169 | A1 | * | 10/2021 | A46B 17/08 |

* cited by examiner

BIODEGRADABLE DISPOSABLE TOILET BRUSH

PRIORITY CLAIM

This application claims priority to U.S. provisional application 63/357,867 filed Jul. 1, 2022.

BACKGROUND

The present invention relates to toilet bowl cleaning brushes. Typically, such brushes are made with plastic handles, a wire loop at the end of the handle which retains a plurality of plastic bristles which are used to do the actual cleaning. When these brushes are not in use cleaning the toilet, they are typically placed in a plastic or metal brush holder which is placed near the toilet. Such storage is messy and inherently leads to the transportation and storage of germs to the brush holder.

US20020054784A1 discloses a flushable toilet cleaning tool formed of a water soluble material includes a handle and a cleaning head. The cleaning tool is configured to permit the user to perform a cleaning operation and thereafter dispose of the cleaning tool by placing it in a toilet bowl where the interaction of the water resident in the bowl with the cleaning tool causes the tool to dissolve sufficiently to permit the cleaning tool to be flushed away. The cleaning tool may include a quantity of cleanser contained within the handle of the tool or alternatively disposed on the cleaning head itself.

WO2013113044A1 also discloses a fully disposable toilet cleaner which can be left to dissolve in the bowl of the toilet after use.

DE10238131A1 discloses a toilet brush with disposable tissue sheet attached to head and spring supported mechanism integrated in handle stick. A mechanism activated by a spring integrated in the handle provides the brush head with a sheet of a biodegradable material soaked with a cleansing fluid and pushes the folded head out of a case (2) for use. When the handle is pushed again the sheet is automatically removed and can be flushed down the toilet.

SUMMARY OF THE INVENTION

The present invention is a biodegradable toilet brush with (a) a brush head made of multiple layers of biodegradable fabric disks and (b) a thin bio-degradable handle.

DESCRIPTION OF THE PREFERRED EMBODIMENT

A product is biodegradable if it is capable of being broken down especially into innocuous products by the action of living things (such as microorganisms) (Merriam Webster).

The Federal Trade Commission provides that:

> Marketers may make an unqualified degradable claim only if they can prove that the "entire product or package will completely break down and return to nature within a reasonably short period of time after customary disposal." The "reasonably short period of time" for complete decomposition of solid waste products? One year.

Figure 1:
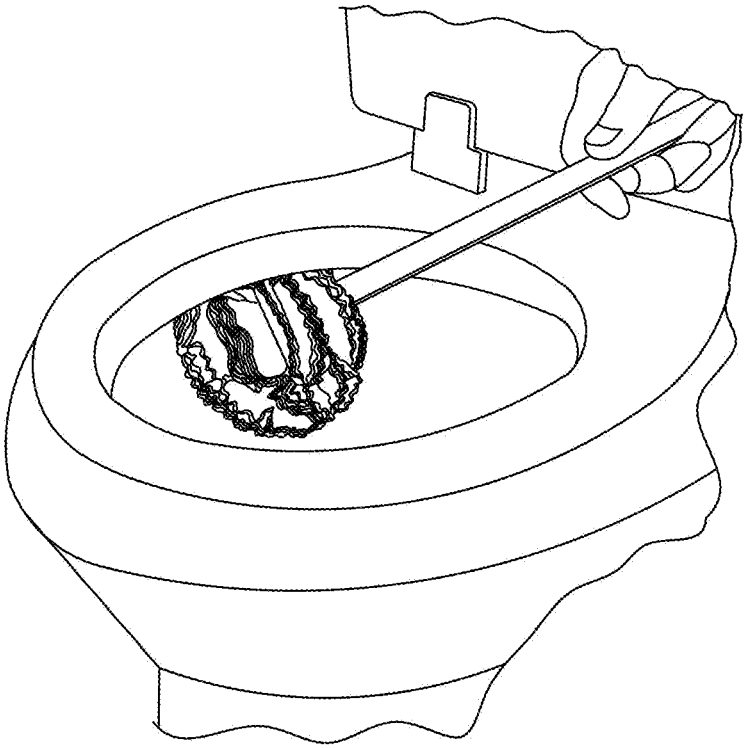
FIG. 1 is a perspective view of a user cleaning a toilet with a biodegradable toilet brush made in accordance with a preferred embodiment of the invention.
Figure 2:
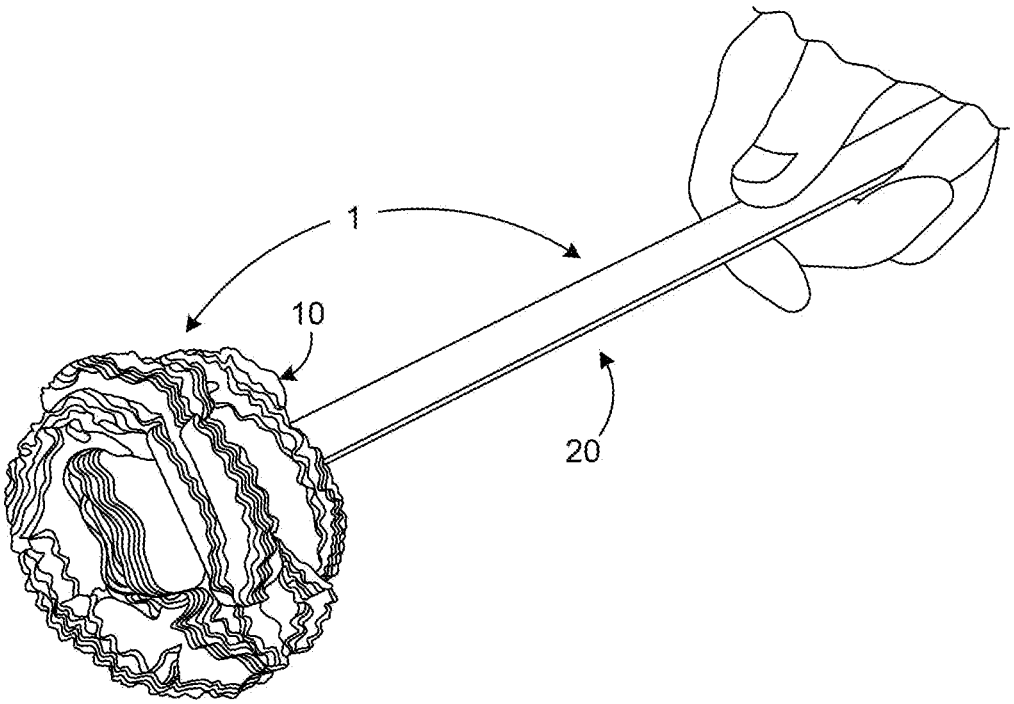
FIG. 2 is a perspective view of the preferred embodiment biodegradable toilet brush.
Figure 3:
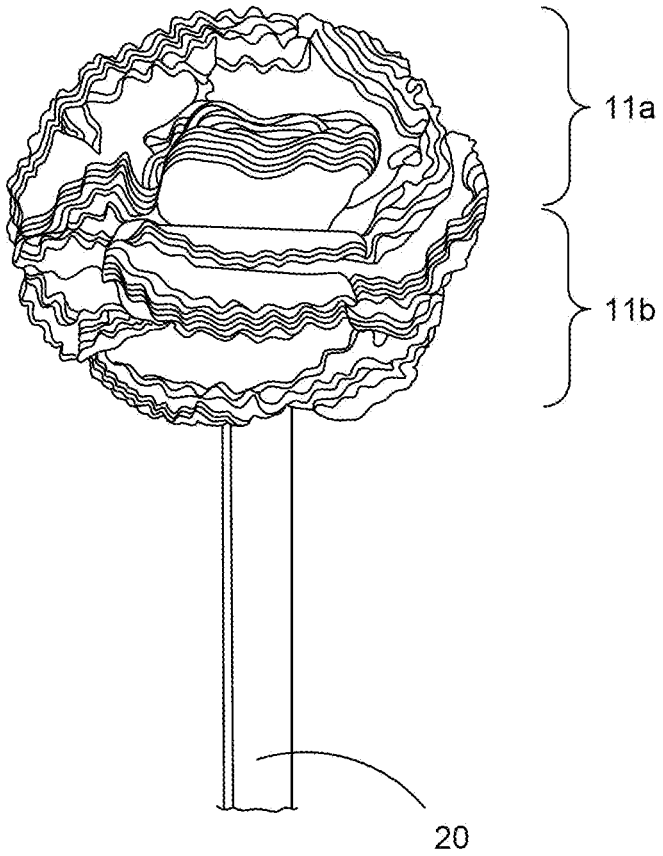
FIG. 3 is a front elevation view of the brush head and a portion of the brush handle of the preferred embodiment biodegradable toilet brush.
Figure 4A:
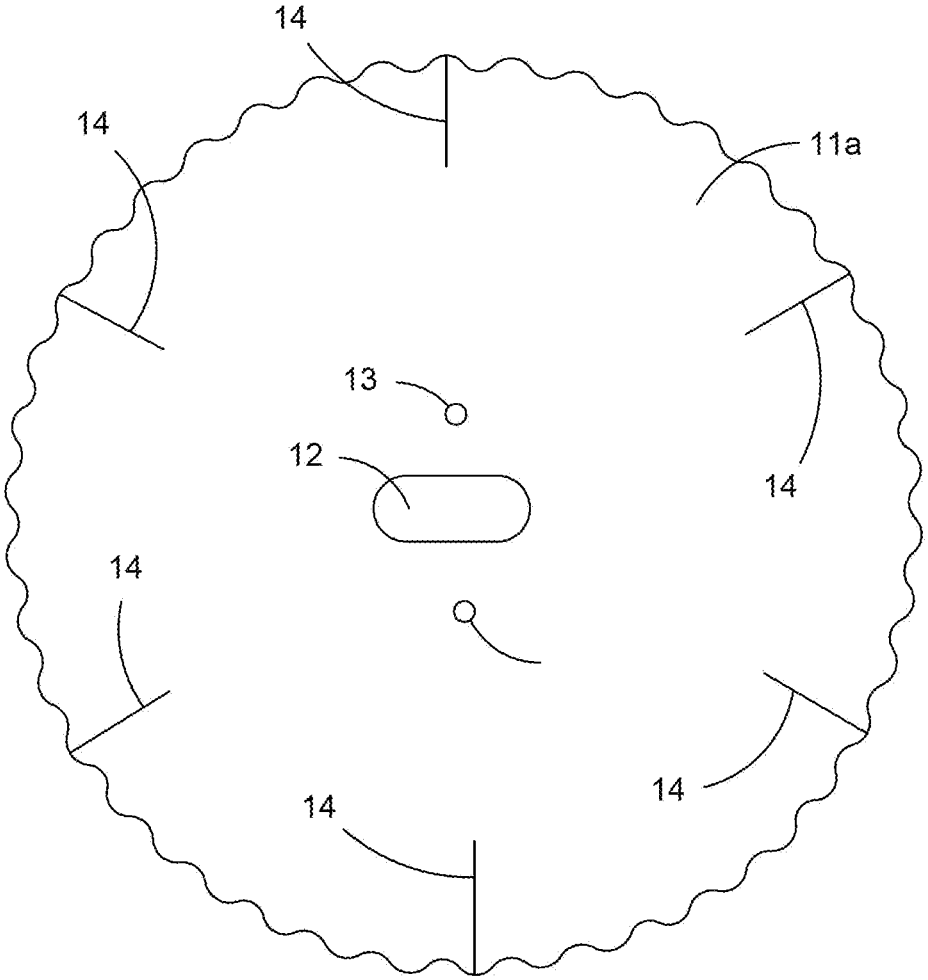
FIG. 4A is a front elevation view of one of a plurality of upper biodegradable cellulose fabric disks used to make the brush head.
Figure 4B:
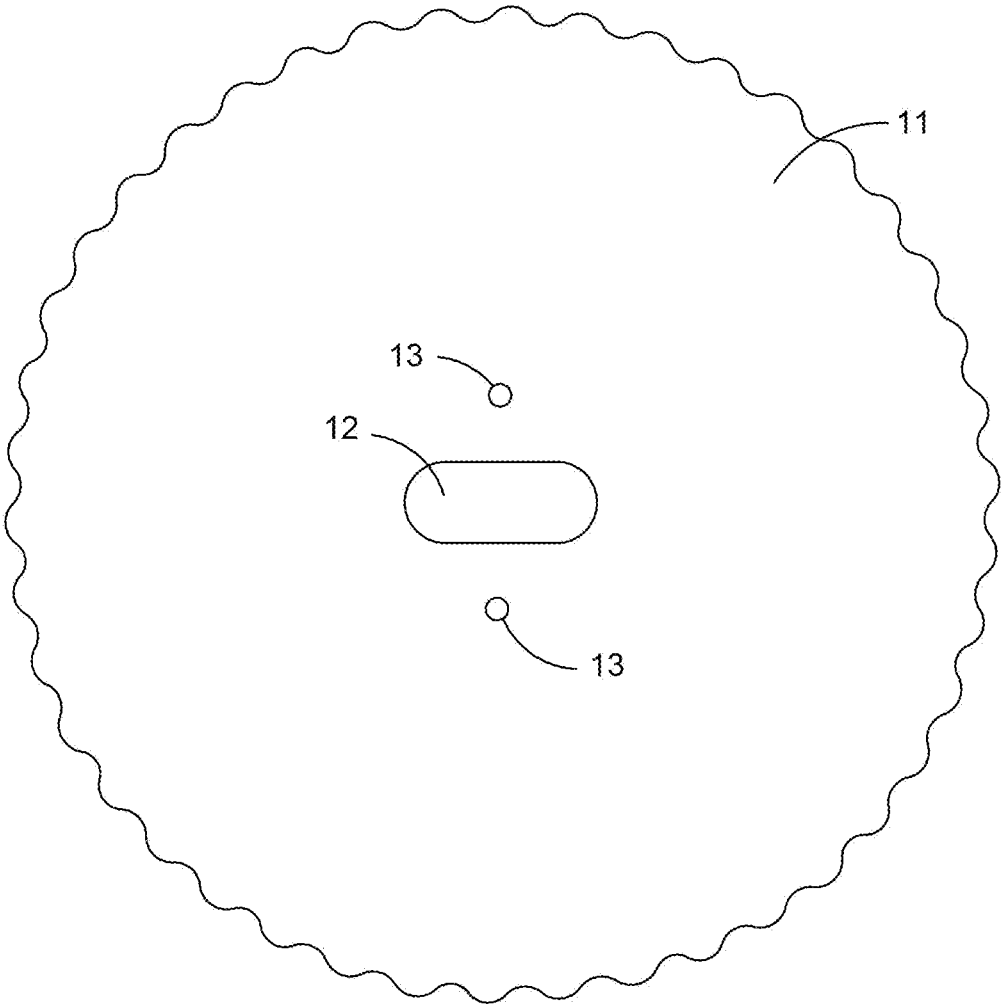
FIG. 4B is a front elevation view of one of a plurality of lower biodegradable cellulose fabric disks used to make the brush head.

Each preferred embodiment toilet brush 1 is comprised of a brush head 10 and a handle 20 (FIGS. 1 and 2). Each brush head is comprised of a plurality of cellulosic fabric discs 11*a* and 11*b* (FIGS. 3, 4A and 4B). The fabric discs are made from "viscose" fibers. They are so named because they are regenerated from a viscous organic liquid, or slurry, of recycled wood pulp treated with chemicals such as caustic soda, ammonia, acetone, and sulphuric acid. Preferably, bamboo wood pulp is used. The fabric discs are preferably woven (or can be non-woven) fabric discs having the characteristics and feel of cotton. Each fabric disc has a thickness of about 0.006 to 0.012 inches, preferably 0.07-0.10.

Figure 5:
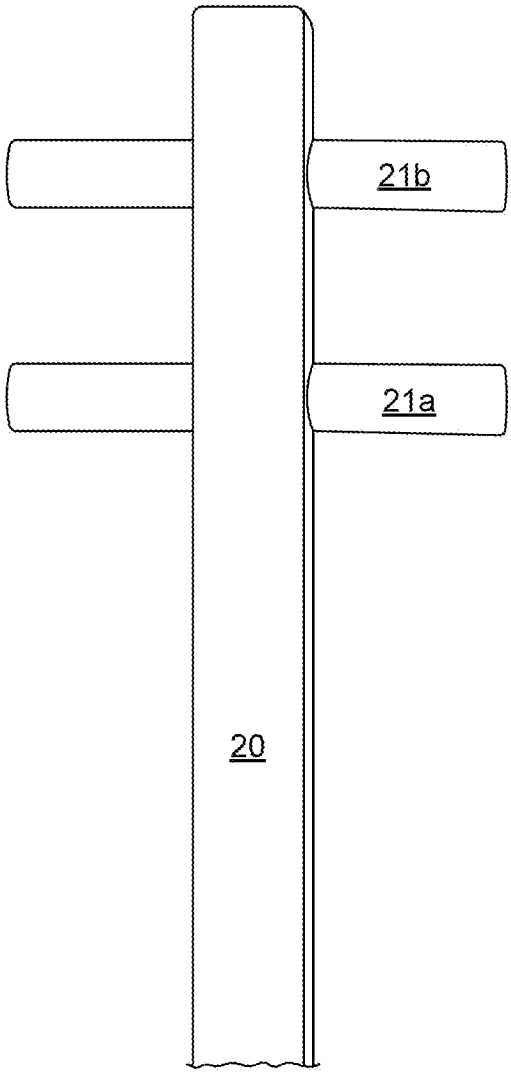
FIG. 5 is a side elevation view of the top of the handle and the two brush head retention pins which pass through the handle and hold the multiple biodegradable fabric disks therebetween.

Preferably, the fabric disks come in two different diameters. The upper fabric disks 11*a* (FIG. 4A) are about 4⅓ inches in diameter and the lower fabric discs 11*b* (FIG. 4B) are about 3½ inches in diameter. 20 cellulose fabric upper disks 11*a* are used in each brush head. 26 lower cellulose fabric disks are used for the lower part of the brush head. Each of the fabric discs had a central slot 12 dimensioned to receive the width of the handle 20 there through. Thus slot 12 will be about ¼ to about ⅜ inch wide and about ½ to about ¾ inch lengthwise. Holes 13 receive both ends of brush head retention pin 21*a* or 21*b* (FIG. 5) there through. Holes 13, as will be described later. Holes 13 are about 0.08 to 0.10 inches in diameter.

Each upper cellulose fabric disk 11*a* has a plurality of blossoming slots 14 extending radially inwardly from the perimeter of the disk to help the brush head obtain a blossom appearance and create more "petals" to increase the cleaning action of the brush head. Preferably, six radial blossoming slots 14 are spaced at equal distances around the perimeter of fabric disk 11*a*, and projecting radially inwardly toward the center of the fabric disk 11*a* about ⅜ to ¾ of an inch. Each 4⅓-inch diameter layer has six equally spaced radially extending slots, extending radially inwardly from the perimeter of fabric disc. There are 26 lower discs 11*b*, none of which are slotted. Two spaced pins 21*a* and 21*b* extending laterally through handle 20 towards the end of thereof (FIG. 5) sandwich the 46 cellulose fabric disks between them and hold them firmly in place, allowing them to spread and extend outwardly into the shape of a ball.

Biodegradable handle 20 is also made from cellulose. Preferably, bamboo is used. Handle 20 is long enough to be used to clean a toilet without forcing the cleaning person to have his or her hand too close to the toilet or toilet water while cleaning. Preferably handle 20 is slightly bowed to facilitate its use. Preferably handle 20 is about ten to about sixteen inches long. Handle 20 is also relatively thin to enhance its biodegradability. Preferably, handle 20 is about ¼ inch to about ⅜ inch thick and about ½ to about ¾ inch wide. Brush head retention pins 21*a* and 21*b* (FIG. 5) extend through spaced holes in handle 20 near the top thereof and hold the plurality of cellulose disks 11*a* and 11*b* in place on handle 20. Brush head retention pins 21*a* and 21*b* are about 0.08 to about 0.10 inches in diameter, and the holes through handle 20 are dimensioned accordingly.

A biodegradable glue is used to hold pins 21*a* and 21*b* in place in the end of handle 20. A preferred embodiment biodegradable glue comprises a combination of water, starch, caustic soda and borax, preferably in the following proportions:

Water 70%
Starch 28%
Caustic soda 0.24%
Borax 0.27%

In assembly, a lower pin 21*a* is inserted through its hole in handle 20 and is glued in place using a biodegradable glue. The top portion of handle 20 above lower pin 21*a* is inserted through the slots 12 in the 26 lower cellulose fabric disks 11*b* and the 20 upper cellulose fabric disks 11*a*, respectively. The upper pin 21*b* is then inserted through the upper hole in handle 20 at a level above the upper and lower cellulose fabric disks and is glued in place with a biodegradable glue. All of the cellulose fabric disks are then locked in place at the top of handle 20.

Figure 6:
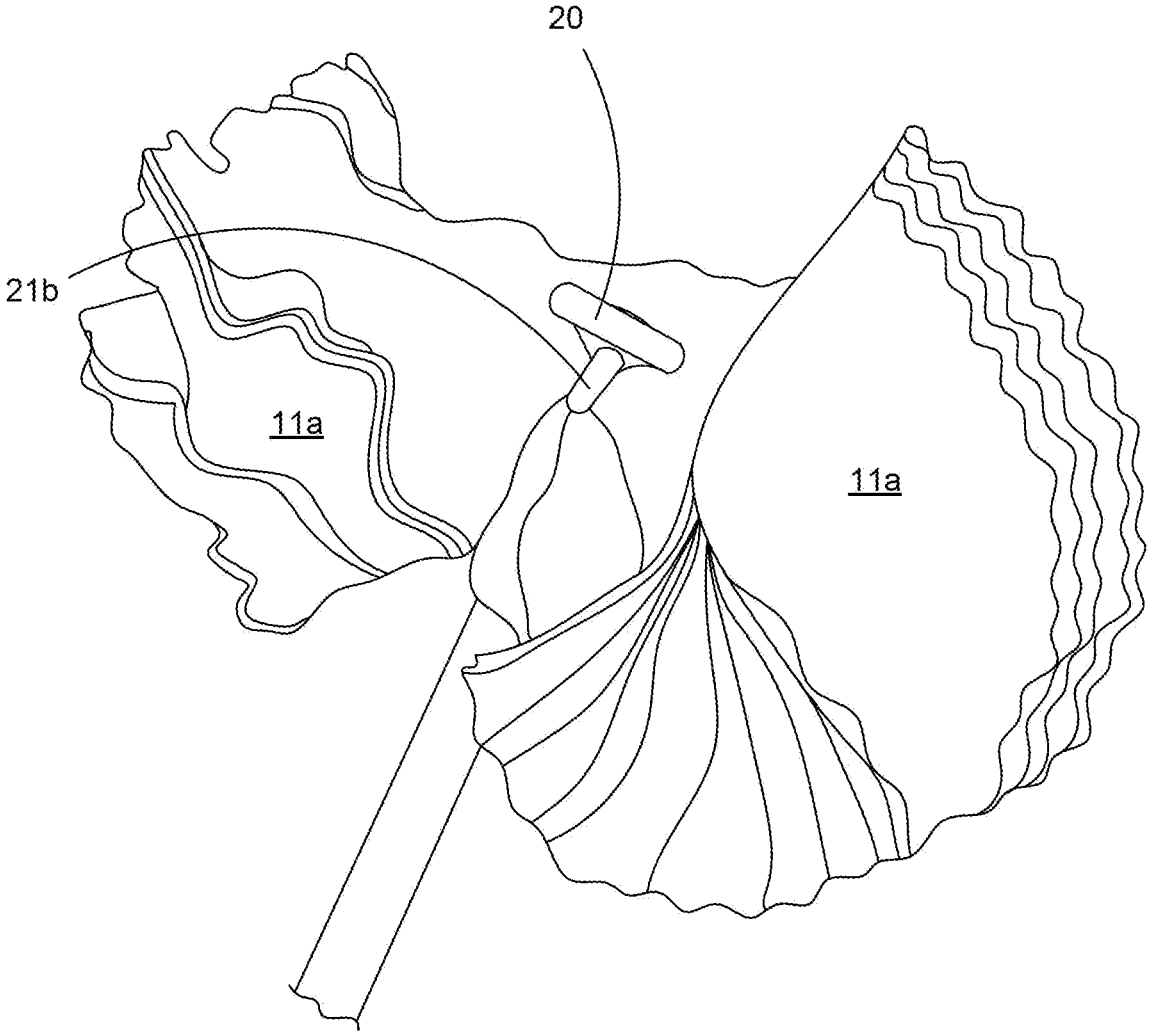
FIG. 6 is a perspective view of the fabric disks of the brush head being held back so the top of the brush handle and the top brush retainer pin are visible.

The cellulose fabric disks 11*a* and 11*b* are then subjected to a bunching operation in which cellulose fabric disks "are crumpled so as to form a roundish "blossom" as the brush head 10 on handle 20. In the process, the ends of lower pin 20*a* are at least partially inserted into pin holes 13 of lower cellulose fabric disks 11*b*. Similarly, ends of upper pin 21*b* are at least partially inserted into pin holes 13 of upper cellulose fabric disks 11*a*. This helps retain the brush head 10 in its "roundish" ball shape for cleaning. FIG. 6 shows the upper fabric disks 11*a* being manipulated so one can see the upper pin 21*b* and the upper end of handle 20 through which it extends.

Though not shown, a biodegradable inner bag, a biodegradable carton and bio-degradable tape are provided for packaging the biodegradable toilet brush 1. All three are preferably made of 100% wood pulp paper. Water based ink is provided for printing on the packaging, comprising preferably:

Water soluble acrylic resin: about 25 to about 35%;
Water: about 15 to about 25%;
Ethyl alcohol: about 5 to about 15%;
Triethylamine: about 5 to about 10%;
Pigment: about 10 to about 30%.

CONCLUSION

The biodegradable toilet brush of the preferred embodiment offers the following advantages:

It is durable enough for multiple uses, with the convenience and cleanliness advantages of a single use, biodegradable design;
It minimizes cross contamination;
It reduces the waste occasioned by a typical plastic toilet brush;
It improves cart and storage cleanliness by eliminating drips and spills;
It avoids the risk of disposable pads clogging toilets;
It minimizes contamination risks;
It is 100% bio-degradable.

I claim:

1. A biodegradable toilet brush comprising:
a biodegradable handle including two spaced pins extending laterally through the handle; and
a brush head made of multiple layers of biodegradable fabric disks attached to and radiating outwardly from their attachment to the handle, wherein:
each of the fabric disks has a central opening dimensioned to receive the handle therethrough, and
the two spaced pins are positioned to sandwich the fabric disks between the two spaced pins and hold the fabric disks in place with respect to the handle while allowing the fabric disks to spread and extend outwardly into a ball shape.

2. The biodegradable toilet brush of claim 1 wherein the fabric disks are made of biodegradable cellulose fibers.

3. The biodegradable toilet brush of claim 2 wherein the biodegradable cellulose fibers are formed from recycled wood pulp.

4. The biodegradable toilet brush of claim 3 wherein the recycled wood pulp includes bamboo wood pulp.

5. The biodegradable toilet brush of claim 1 wherein each of the fabric disks has a thickness of about 0.06 inches to about 0.12 inches.

6. The biodegradable toilet brush of claim 5 wherein each of the fabric disks has a thickness of about 0.07 inches to about 0.10 inches.

7. The biodegradable toilet brush of claim 1 wherein the fabric disks include:
upper fabric disks about 4⅓ inches in diameter, and
lower fabric disks about 3½ inches in diameter.

8. The biodegradable toilet brush of claim 1 wherein at least one of the fabric disks has a plurality of blossoming slots extending radially inwardly from a perimeter of the fabric disk to achieve a blossom appearance of the brush head.

9. The biodegradable toilet brush of claim 1 wherein the fabric disks are crumpled so as to form a roundish "blossom" shape for the brush head.

10. The biodegradable toilet brush of claim 1 wherein:
a first plurality of the fabric disks is attached to the handle in position as an upper brush portion;
a second plurality of the fabric disks is attached to the handle in position as a lower brush portion;
the first plurality of fabric disks is slotted; and
the second plurality of fabric disks is unslotted.

11. The biodegradable toilet brush of claim 10 wherein six radial blossoming slots are spaced at equal distances around a perimeter of each of the first plurality of fabric disks projecting radially inwardly toward a center of the fabric disk about ⅜ inch to about ¾ inch.

12. The biodegradable toilet brush of claim 1 wherein:
the handle is made from cellulose material,
the handle is bowed, and
a length of the handle is configured to space apart a hand of a user of the biodegradable toilet brush from contact with toilet water while using the biodegradable toilet brush to clean a toilet.

13. The biodegradable toilet brush of claim 1 wherein the handle is about ¼ inch to about ⅜ inch thick and about ½ inch to about ¾ inch wide.

14. The biodegradable toilet brush of claim 1 wherein each of the two spaced pins extends through spaced holes in the handle near a top of the handle to hold the fabric disks in place on the handle.

15. The biodegradable toilet brush of claim 1 wherein the central opening is a slot.

16. A biodegradable toilet brush comprising:

a biodegradable handle including two spaced pins extending laterally through the handle; and a brush head made of multiple layers of biodegradable fabric disks attached to and radiating outwardly from their attachment to the handle, wherein:

the two spaced pins are positioned to sandwich the fabric disks between the pins and hold the fabric disks in place while allowing the fabric disks to spread and extend outwardly into a ball shape, at least some of the fabric disks have a plurality of blossoming slots extending radially inwardly from a perimeter of the disk to achieve a blossom appearance of the brush head, and a length of the handle is configured to space apart a hand of a user of the biodegradable toilet brush from contact with toilet water while cleaning a toilet using the biodegradable toilet brush.

17. The biodegradable toilet brush of claim 16 wherein:

a first plurality of the fabric disks is attached to the handle in position as an upper brush portion;

a second plurality of the fabric disks is attached to the handle in position as a lower brush portion;

the first plurality of fabric disks is slotted; and the second plurality of fabric disks is unslotted.

18. The biodegradable toilet brush of claim 17 wherein:

the fabric disks are made of biodegradable cellulose fibers;

each of the fabric disks has a thickness of about 0.06 inches to about 0.12 inches;

the handle is made from biodegradable cellulose material; and the handle is about ¼ inch to about ⅜ inch thick and about ½ inch to about ¾ inch wide.

19. The biodegradable toilet brush of claim 18 wherein each of the two spaced pins are configured to:

extend through spaced holes in the handle near a top of the handle; and hold a plurality of the fabric disks in place on the handle.

* * * * *